United States Patent [19]

Cheney

[11] Patent Number: 4,976,432

[45] Date of Patent: Dec. 11, 1990

[54] SECTIONED AND HEIGHT ADJUSTABLE SINGLES STICKS WITH MEASUREMENT DEVICE

[76] Inventor: LeRoy C. Cheney, 1415 E. Pecos, Hobbs, N. Mex. 88240

[21] Appl. No.: 304,726

[22] Filed: Jan. 30, 1989

[51] Int. Cl.[5] ..... A63B 61/00

[52] U.S. Cl. ..... 273/29 B

[58] Field of Search ..... 273/29 B, 29 BB, 29 BC, 273/29 BD, 29 BE, 29 BF, 29 BG

[56] References Cited

U.S. PATENT DOCUMENTS

| | | | |
|---|---|---|---|
| 4,291,875 | 9/1981 | Smith, Jr. | 273/29 B |
| 4,638,998 | 1/1987 | Shannon, Jr. | 273/29 BB |
| 4,720,112 | 1/1988 | Stettner et al. | 273/29 BB |

*Primary Examiner*—Theatrice Brown

[57] ABSTRACT

An improved tennis singles stick (42), comprising sections (18) and (26) for convenient portability, a tennis net height adjustment mechanism (9) that will accommodate various widths of tennis net bands (54) and conveniently adjust the height of the tennis net (44) to the height specified by USTA tennis rules, a measurement device located on said improved singles stick so as to provide a means for conveniently marking the proper position (60) on the tennis court for placing said improved singles stick (42) at the tennis net (44) as specified by USTA tennis rules, said sections (18) and (26) combining together, as illustrated in FIG. 2, FIG. 3 and FIG. 4, to form a single unit (42) which conforms to USTA tennis rules specifications for singles sticks.

3 Claims, 2 Drawing Sheets

Fig. 1
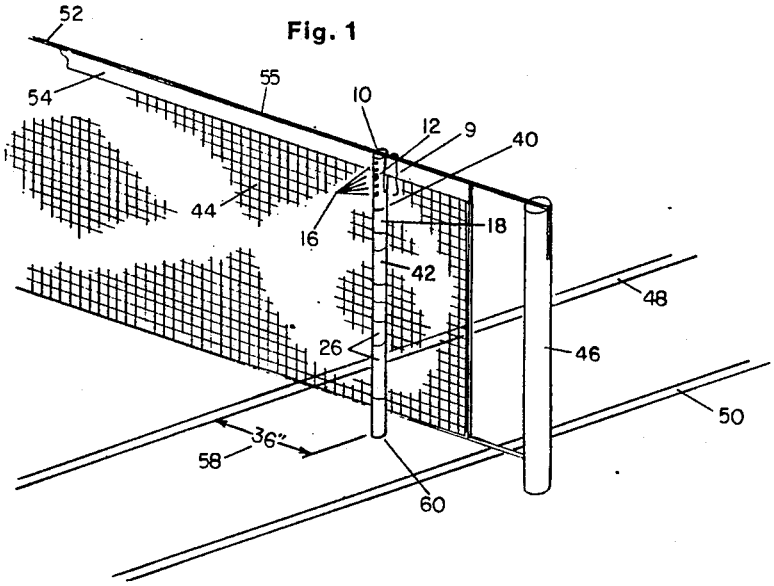
Fig. 2
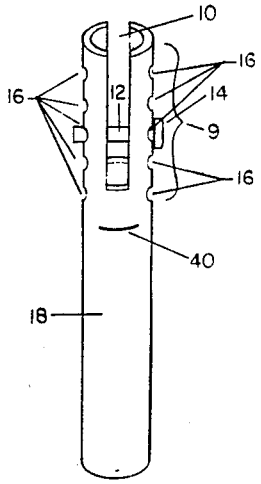
Fig. 3
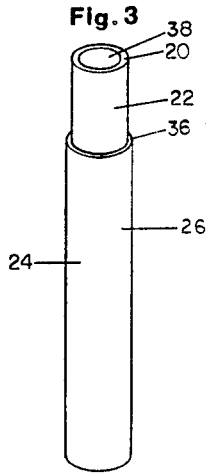
Fig. 5
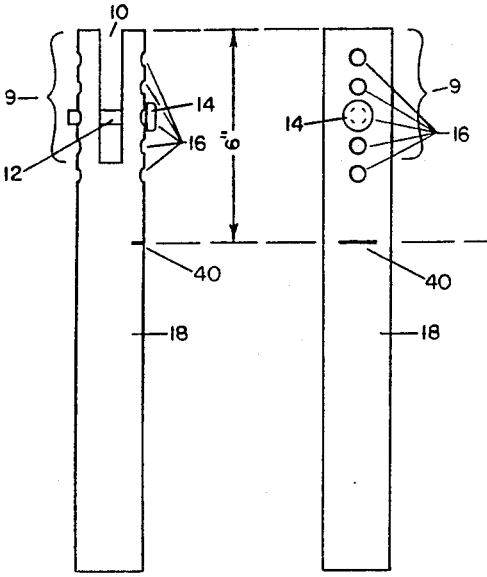
Fig. 6
Fig. 7
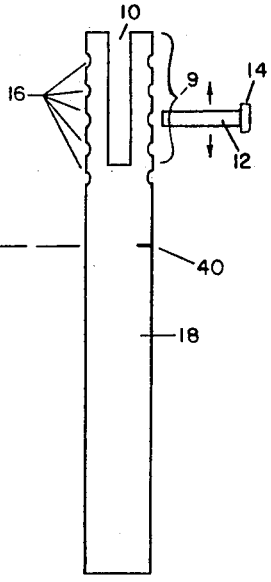
Fig. 4
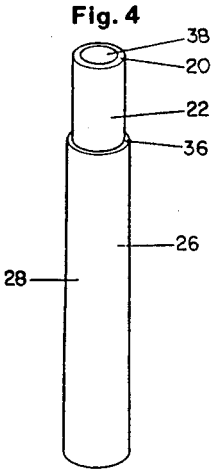
Fig. 8
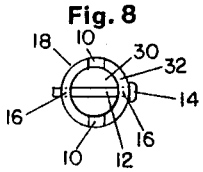
Fig. 9
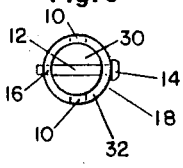

SECTIONED AND HEIGHT ADJUSTABLE SINGLES STICKS WITH MEASUREMENT DEVICE

BACKGROUND

1. Field of Invention

This invention relates to singles sticks as defined by the official tennis rules of the United States Tennis Association (U.S.T.A.), which was organized in 1881, as follows: "The court . . . shall be divided across the middle by a net suspended from a cord or metal cable . . . the ends of which shall be attached to, or pass over, the top of the two posts . . . the centers of the two posts shall be 0.914 m (3 ft) outside the court and the height of the posts shall be such that the top of the cord or metal shall be 1.07 m (3 ft 6 in) above the ground . . . When combined doubles . . . and singles court with a doubles net is used for singles, the net must be supported to a height of 1.07 m (3 ft 6 in) by means of two posts, called "singles sticks", which shall be not more than 7.5 cm (3 in) square or 7.5 cm (3 in) in diameter . . . The centers of the singles sticks shall be 0.914 m (3 ft 6 in) outside the singles court on each side . . . There shall be a band covering the cord or metal cable and the top of the net of not less than 5 cm (2 in) nor more than 6.3 cm (2½ in) in depth on each side . . . "

2. Description of Prior Art

Application is aware of some patents relating to improved singles sticks, namely, U.S. Pat. No. 4,638,998 to Shannon, Jr., and U.S. Pat. Nos. 4,291,875 and 4,440,393 to Smith.

U.S. Pat. No. 4,638,998 describes a singles stick with an attachment connected to the net post.

U.S. Pat. Nos. 4,291,875 and 4,440,393 describe a singles stick that is split vertically up the middle.

While various types of singles sticks have been used by tennis players for over a hundred years, they have a number of disadvantages. Heretofore, singles sticks have been too long, too heavy, and too awkwardly constructed to be conveniently carried by players in their equipment tote bag, measurement devices have had to be either provided separately, or, when attached to the singles stick, they have tended to make the singles stick even more heavy and awkwardly constructed, and, prior art singles sticks have not provided players with a singles stick that has a mechanism for adjusting the depth of the slot, notch, or groove, to accommodate the various widths of net bands authorized by U.S.T.A. tennis rules, independent of attachments or separate measuring devices.

The prior art correctly points out that singles sticks are usually unavailable at public courts, and even when singles sticks are supposed to be available at clubs and other court locations, they are usually difficult or impossible to find, which is the reason most players must provide their own singles sticks for practice and play.

Most players carry an equipment tote bag with them when they play or practice in order to provide a convenient place to store their equipment for safe keeping and protection from loss. Unfortunately, heretofore, singles sticks have been too long, too heavy, and too awkwardly constructed to be conveniently carried by most players in their equipment tote bag. This major defect in the prior art has been a significant factor in contributing most players simply do not practice or play with nets supported with singles sticks, which has contributed to the difficulty most players have in trying to fine tune their skill level to effectively compete with players who regularly practice and play with nets supported by singles sticks.

My invention solves this problem by making available to ordinary players around the world an improved singles stick that uses a variety of light weight materials sectioned into pieces (18) and (26) short enough to be safely and conveniently fitted into most of the commonly used equipment tote bags used by tennis players.

Another disadvantage of prior art singles sticks is that prior art singles sticks themselves, independent of attachments of separate measuring devices, do not provide players with a convenient, quick, and easy to use means for measuring the required distance from the singles side line for correct placement of the singles stick at the net.

The prior art is correct in pointing out that when a court is converted from doubles to singles play that precise measurement is needed to properly position the singles stick at the net, and, that marks made on the court are usually ineffective because such marks can quickly vanish. However, while the prior art describes a means for providing accurate placement of an improved singles stick that is attached to the net post (46), such an attachment does not provide a means for its use independently from attachment to the net post (46). Furthermore, such a singles stick is even heavier and more awkwardly constructed than most conventional prior art singles sticks, and, most players are not ordinarily willing to carry such long, heavy, and awkwardly constructed equipment with them when they practice or play, and, they find it often inconvenient and time consuming to continually have to connect attachments to the net post every time they change courts.

My invention, being light weight and convenient to carry in most player's equipment tote bag, solves the measurement problem by providing players with an improved singles stick that has a simple, easy to use strategic measurement mark (40) on the singles stick itself, completely independent of any attachments or separate measuring devices.

Another problem with prior art singles sticks is that they can not be adjusted to accommodate the various widths of net bands allowed by U.S.T.A. tennis rules. While some of the prior art solves this problem by simply letting the net band fall to its natural length between split sticks, and, using notched grooves to support the net cable, rather than the net bands, these singles sticks, like other prior art singles sticks, are too long to fit conveniently in most player's equipment tote bags. Whereas, my improved singles sticks are not only convenient to carry in most equipment tote bags, my improved singles sticks provide a quick and simple means for installing the singles stick as well as provide a means for quickly and easily adjusting the height adjustment mechanism to support the net band, regardless of its width, which allows any width net band to fit securely into the slot (10) without having to spend unnecessary time securing two separate split sticks to the net.

Furthermore, most other prior art singles sticks usually require that players jam the net band down into a fixed depth groove which can cause the net band to pop up thereby altering the net height undesirably, or, the net may even pop completely out of the groove altogether. My invention solves this problem by providing the player with an improved singles stick that has an adjustable depth slot (10) that will receive any width net band at its natural length by simply making a quick and easy adjustment to the height adjustment mechanism (9).

Thus, while prior art singles sticks are effective for the purpose for which they are intended, the prior art does not provide tennis players with a single stick that is sectioned (18) and (26) so it can be easily and conveniently carried in the player's equipment tote bag for safe and convenient availability whenever and where ever it is needed, nor does prior art provide players with a singles stick that has a height adjustment mechanism (9) that will adjust to accommodate any size net band authorized by U.S.T.A. tennis rules, nor does prior art provide tennis players with a singles stick that has a simple, easy to use strategic measurement mark (40) on the singles stick itself completely independent of any attachments or separate measuring devices.

OBJECTS AND ADVANTAGES OF MY INVENTION

Most tennis players want equipment that is state of the art, fast, accurate, simple and easy to use. In short, they want equipment that is efficient.

Some of the advantages of my improved singles sticks are that it provides a sectioned singles stick that provides a means for conveniently and safely carrying and storing them in most player's equipment tote bag, provides a strategic measurement mark whereby players can quickly and efficiently measure for the correct installation of said singles stick at the net, and provides a height adjustment mechanism which provides a means of quickly and efficiently securing various widths of net bands, without the disadvantages of the prior art.

Because of the disadvantages of prior art singles sticks, most players around the world have not usually been able to practice and play with nets supported by singles sticks. This has had the effect of placing most players at a competitive disadvantage compared to players who have practiced and played with singles sticks regularly.

Those familiar with the art understand the critical importance of securing the singles net to U.S.T.A. regulation height during practice as a means necessary for the proper development of player skills. The critical importance of developing and maintaining a level of skill in practice that accurately corresponds to that required by tournament and other match play can not be overemphasized. Players who consistently and regularly practice and play with nets supported by singles sticks are able to fine tune their level of skill to a degree normally not available to players who do not practice and play with nets supported by singles sticks.

Accordingly, some of the main objects of my invention are to make available to tennis players around the world an improved singles stick (42) that will provide them with the opportunity to effectively compete with other tennis players who normally practice and play with nets supported by singles sticks. This will provide millions of tennis players who have never used singles sticks before with an unparalleled opportunity to dramatically improve their level of skill which will revolutionize the game of tennis by significantly increasing the competitive level of tennis generally.

While these objects and advantages over the prior art are the main objects and advantages of my invention, other objects and advantages will become apparent from consideration of the drawings and ensuing description of them.

LIST OF DRAWING REFERENCE NUMERALS

8—omitted
9—Height adjustment mechanism as illustrated in FIG. 3 and FIG. 4, comprising (10), (12), and (16)
10—Slot
12—Peg constructed of light weight material
14—Peg Cap (head)
16—Holes
18—Top Section constructed of light weight material
20—Casing of Dowell (22) constructed of light weight material
22—Dowell constructed of light weight material
24—Middle Section constructed of light weight material
26—Lower Sections constructed of light weight material
28—Bottom Section constructed of light weight material
30—Hollow core of Top Section (18)
32—Casing of top section (18) constructed of light weight material
34—Hollow core of lower section (26)
36—Casing of Lower Section (26)
38—Hollow core of dowell (22)
40—Strategic Measurement Mark
42—Assembled improved singles stick properly positioned at net
44—Tennis net
46—Conventional net post
48—Singles Line
50—Double Line
52—Net Cable
54—Net Band (net tape)
55—Top of Net
56—Omitted
58—Required distance from singles line to center of singles stick for properly positioning singles stick at net
60—Proper position for positioning singles stick on tennis court

BRIEF DESCRIPTION OF DRAWINGS

FIG. 1 is a perspective view of a first embodiment of an improved singles stick (42) or athletic net height adjustment mechanism according to U.S.T.A. specifications specifically illustrating the invention properly positioned (60) at the tennis net (44) between the net band (54) and the ground, in its fully assembled condition.

FIG. 2, FIG. 3 and FIG. 4 are perspective views of each of the sections (18) and (26) of the invention illustrating how the sections (18) and (26) combine to form a single unit.

FIG. 5, FIG. 6, FIG. 7, FIG. 8 and FIG. 9 are expanded views of the top section (18) specifically illustrating the height adjustment mechanism (9), comprising the holes (16), the slot (10) and peg (12), and, more specifically, illustrating the removal of peg (12) form the middle hole (16) and showing peg (12) available for movement upward or downward for insertion into a higher or lower hole (16) for adjusting the effective depth of slot (10) for adjustment to receive any width of net band (54) to secure the net cable (52) and top of the net (55) to its required height.

DETAILED DESCRIPTION OF DRAWINGS

Figure 10:
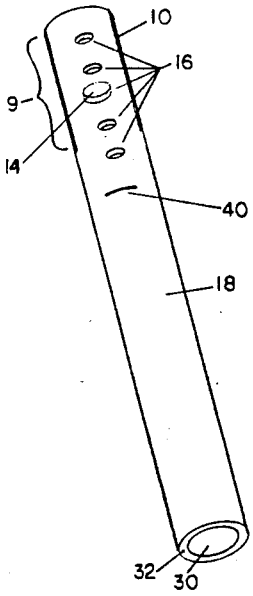
FIG. 10, FIG. 11 and FIG. 12 are expanded views of angles perspectives of the top section (18) illustrating the height adjustment mechanism (9) comprising holes (16), slot (10) and peg (12) with slot (10) located at the upper end of top section (18), and peg (12) inserted through the middle hole (16), illustrating a slot (10) adjusted to accommodate a smaller size net band (54).

FIG. 1 is a perspective view of a first embodiment of an improved singles stick (42) or athletic net height adjustment mechanism according to U.S.T.A. specifications, specifically illustrating the inventions proper position (60) at the tennis net (44) between the net band (54) and the ground, in its fully assembled condition. The singles line (48) represents the edge of the singles court, which is to the left of the singles line (48), the doubles line (50) represents the edge of the doubles court, which is to the left of the doubles line (5), thus forming a typical doubles court used for singles play, with the net (44) passing over the top of the net post (46), and the singles stick in its proper position (60) supporting the net band (54), hence net cable (52) and the top of the net (55) to their proper height as specified in the U.S.T.A. tennis rules, and located the required distance (58) from the edge of the singles line (48) as measured by the strategic measurement mark (40). The singles stick (42) is shown to comprise a top section (18) and two lower sections (26), which is the preferred embodiment of the singles stick, with the top section (18) comprising the strategic measurement mark (40) and the height adjustment mechanism (9) with the height adjustment mechanism (9), comprising holes (16), peg (12), and slot (10), supporting net (44) at its proper position (60), Peg (12) is shown inserted into the middle hole indicating that net band (54) is of less depth than the largest net band authorized for use by U.S.T.A. tennis rules.

FIG. 2, FIG. 3 and FIG. 4 are perspective views of each of the sections (18) and (26) of improved singles stick (42), and illustrating how the sections (18) and (26) combine to form a single unit, represented in its disassembled form showing random length sections (26) and the top section (18) positioned ready for assembly to form said single unit as described in FIG. 1. The dowells (22) located in the lower sections (26) protrude from one end of the lower section (26) for insertion into the next higher section to form said complete unit. While FIG. 2, FIG. 3 and FIG. 4 show three sections, namely two lower sections (26) and the top section (18) ready to be joined together to form said single unit as illustrated in FIG. 1, an alternative number of random length lower sections could be used as long as their combined length when combined with the top section (18) conforms the specifications for singles sticks as required by U.S.T.A. tennis rules. FIG. 2 is a view of the top section (18) comprising said section, height adjustment mechanism (9), which is comprised of holes (16), peg (12), which is shown in a position exposing peg cap (14), and slot (10), and, strategic measurement mark (40). While FIG. 2 shows a height adjustment mechanism comprising five holes (16), an alternate number of holes (16) could be used. Similarly, peg (12) is shown to be inserted through the middle hole (16) ready for reception of a net band whose depth is less than the maximum authorized by U.S.T.A. tennis rules. The length, size and shape of the sections (18) and (26) is limited only by U.S.T.A. tennis rules specifications for singles sticks, and, while the preferred embodiment of sections (18) and (26) are illustrated in FIG. 2, FIG. 3 and FIG. 4, sections (18) and (26) may be any length so as to form a combined length, when assembled with said top section that conforms to U.S.T.A. rules specifications for singles sticks. Slot (10) is of a width and depth that will receive any width net band specified by U.S.T.A. regulations but peg (12) is shown in a position ready to receive a smaller width net band, with the bottom of the net band resting on peg (12) rather than on the bottom of slot (10) as would be the case with a maximum width net band, in which case peg (12) could be inserted into the bottom hole just below the bottom of the slot (10) for convenient storage, thus, the selection of which hole (16) to insert peg (12) into depends upon the width of the net band. FIG. 3 and FIG. 4 are views of the lower sections (26) illustrating dowell (22) partially inserted into the top end of said sections ready for insertion into bottom end of the next higher section. While the method of connecting the sections together with dowells (22), as shown, is the preferred method for connecting the sections together, variations of this method or alternate methods could also be used. When all of the sections (18) and (26) are joined together as indicated by the dotted lines showing the altered position of the dowell (22) when the sections (18) and (26) are joined together, the structure assembles to conform to U.S.T.A. tennis rules specifications, and forms a single unit as illustrated in FIG. 1, comprising the top section (18), the middle section (24), and the bottom section (28). While the preferred embodiment of dowell (22) and sections (18) and (26) is utilizes light weight, hollow core material as illustrated by the hollow core dowell (38) and the drawings, showing casing (36) and casing (20), any suitable material properly modified could be used.

FIG. 5, FIG. 6, FIG. 7, FIG. 8 and FIG. 9 are expanded views of the top section (18) specifically illustrating the height adjustment mechanism (9), comprising the holes (16), the slot (10) and peg (12), and, more specifically, illustrating the removal of peg (12) from the middle hole (16) and showing peg (12) available for movement upward or downward for insertion into a higher or lower hole (16) for adjusting the effective depth of slot (10) to receive any width of net band (54) to secure the net cable (52) and top of the net (55) to its required height. FIG. 5 shows peg (12) inserted through the middle hole (16) and passing through slot (10), then protruding through the corresponding parallel hole on the opposite side of said section. FIG. 6 is a 90 degree view of FIG. 5 showing peg cap (14) which indicates that peg (12) is inserted through the middle hole as shown in FIG. 5. FIG. 7 is a side view similar to FIG. 5 but showing peg (12) removed from the hole and in position to be adjusted upward or downward to fit into any of the other holes (16), thereby narrowing or widening slot (10) which makes the distance from the top of slot (10) to the effective bottom of slot (10) have a varied depth in order to accommodate the various widths of net bands (54) authorized by U.S.T.A. tennis rules, thereby comprising height adjustment mechanism (9). FIG. 8 is a top view showing peg (12) protruding through a hole (16) on one side of said section, passing through slot (10) and protruding through the corresponding parallel hole (16) on the opposite side of said section. FIG. 9 is a bottom view showing peg (12) in the same position as shown in FIG. 8 but viewed from the bottom of said section. FIG. 8 and FIG. 9 show that the top section (18), in its preferred embodiment, also comprises a casing (32) with a hollow core (30) which indicates that said section is construction of a light weight material which can be of many varieties, shapes, and forms, and even comprised of a solid core properly modified, so long as U.S.T.A. tennis rules specifications for singles sticks are complied with. Dowell (22) may be constructed of any suitable material, and, various sizes, shapes, and modifications may be used. Many other modifications of said section will become evident to those familiar with the art but FIG. 5, FIG. 6, FIG. 7, FIG. 8 and FIG. 9 show the preferred embodiment. Strategic measurement mark (40) is shown in its proper position, namely, six inches below the top of said section on the outside of said section, so that when said section is combined with the lower sections (26) a fixed distance, namely thirty six inches, is provided between said measurement mark and the bottom of the bottom section (28), as shown in FIG. 2, FIG. 3 and FIG. 4.

Figure 11:
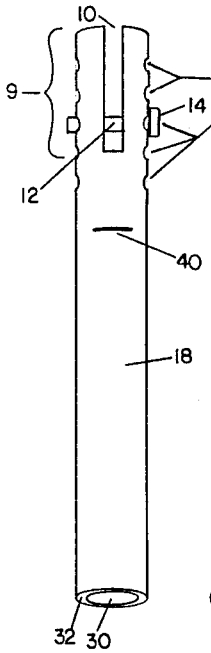
Figure 12:
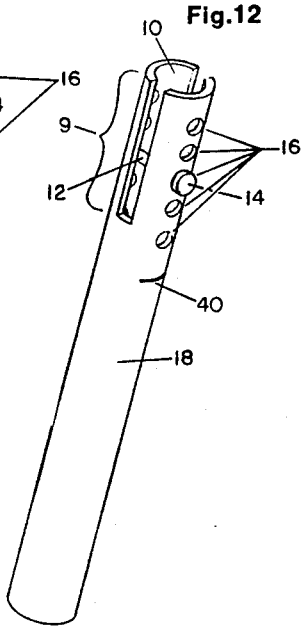

FIG. 10, FIG. 11 and FIG. 12 are expanded views of an angled perspective of top section (18) illustrating the height adjustment mechanism (9) comprising holes (16), slot (10) and peg (12) as illustrated in FIG. 2, FIG. 3, FIG. 4, FIG. 5, FIG. 6, FIG. 7, FIG. 8 and FIG. 9, with slot (10) located at the upper end of said section, and peg (12) inserted through the middle hole (16), illustrating a slot (10) that is adjusted to accommodate less than maximum size net band (54), height adjustment mechanism (9). FIG. 10, FIG. 11 and FIG. 12 also show peg cap (14), casing (32), hollow core (30), and strategic measurement mark (40) as illustrated and described in FIG. 2, FIG. 3, FIG. 4, FIG. 5, FIG. 6, FIG. 7, FIG. 8 and FIG. 9.

Figure 14:
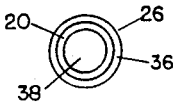
FIG. 13, FIG. 14 and FIG. 15 are expanded views of a lower section (26) illustrating the dowell (22) method, which is the preferred method, of preparing the lower section (26) to be joined together and to the top section (18) as illustrated in FIG. 1. While the dowell method is the preferred method of joining the sections (18) and (26) together, other methods and variations of this method may also be considered.
Figure 13:
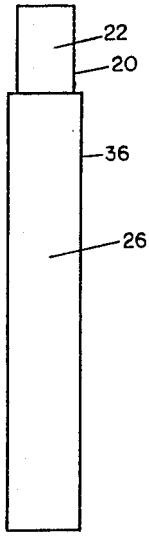
Figure 15:
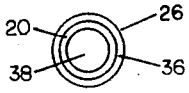

FIG. 13, FIG. 14 and FIG. 15 are expanded views of a lower section (26) illustrating the dowell (22) method, which is the preferred method, of preparing the lower sections (26) to be joined together and to the top section (18) as illustrated in FIG. 1. While the dowell method is the preferred method of lining the sections (18) and (26) together, other methods and variations of this method may also be considered for use. FIG. 13 shows dowell (22) partially inserted into the lower section (26) at one end with the remainder of said dowell protruding out in position for insertion into the lower end of one of the other lower sections (26) or into the lower end of top section (18) as illustrated in FIG. 2, FIG. 3 and FIG. 4. FIG. 14 is a view of dowell (22) and a lower section (26) as it would appear from a view of the top end of said section. FIG. 15 is a view of dowell (22) and a lower section (26) as it would appear from a view of the bottom end of said section. Both FIG. 14 and FIG. 15 show dowell (22) partially inserted into said section as illustrated in FIG. 13. The lower sections (26) and dowell (22) may be of random length so long as the lower sections (26) are able to combine with the random number of lower sections (26) and top section (18) to form an assembled unit that conforms to U.S.T.A. specifications for singles sticks, as illustrated and described in FIG. 2, FIG. 3, FIG. 4, FIG. 5, FIG. 6, FIG. 7, FIG. 8, FIG. 9, FIG. 10, FIG. 11 and FIG. 12. Hollow core dowell (38), casing of dowell (22), casing of lower sections (36) shown in FIG. 14 and FIG. 15 show the preferred embodiment of lower section (26) which indicates the light weight construction of said sections.

Figure 16:
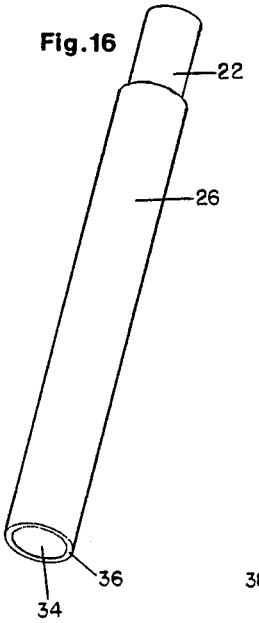
FIG. 16 and FIG. 17 are views of angled perspectives of the lower sections (26) illustrating the dowell method of joining the sections (18) and (26) together as illustrated in FIG. 1, FIG. 2, FIG. 3 and FIG. 4.
Figure 17:
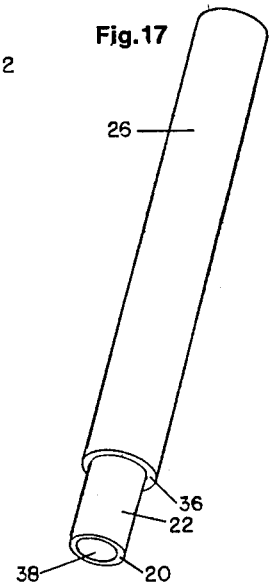

FIG. 16 and FIG. 17 are views of angled perspectives of the lower sections (26) illustrating the dowell method of joining sections (18) and (26) together as illustrated in FIG. 1, FIG. 2, FIG. 3 and FIG. 4. FIG. 16 shows said section inverted 180 degrees compared to FIG. 17. Both of these views show dowell (22) partially inserted into one end of said section with the remainder of said dowell protruding outward and ready for insertion into the next higher section (26), if applicable, and/or top section (18) as illustrated and described in FIG. 1, FIG. 2, FIG. 3 and FIG. 4. The lower sections (26), comprising casing of lower section (36), dowell (22), casing of dowell (20) and hollow core of dowell (38) may be of random length, light weight material as illustrated and described in FIG. 13, FIG. 14 and FIG. 15.

Figure 18:
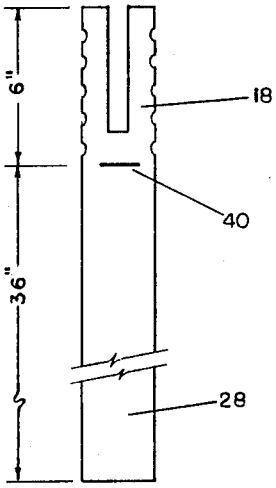
FIG. 18 is a view of the strategic measurement mark (40) located on the outside of the top section (18), six inches below the top of the top section (18), thereby providing a strategic measurement mechanism comprising said strategic measurement mark and that part of the singles stick between said strategic measurement mark and the bottom of the bottom section (28) thereby providing the player with a strategic measuring instrument on the singles stick itself that is thirty six inches in length which players can quickly and easily use to make the required measurements for placing the singles stick at the net independently of any attachments or separate measuring devices when the invention is fully assembled as illustrated in FIG. 1, irrespective of the number of, or variations in the length, of, the sections (18) and (26) utilized in said assembly so long as said assembly forms a singles stick that conforms to U.S.T.A. specifications for singles sticks.

FIG. 18 is a view of the strategic measurement mark (40) located on the outside of top section (18) six inches below the top of top section (18), thereby providing a strategic measurement mechanism comprising said strategic measurement mark and that part of the singles stick between said strategic measurement mark and the bottom of bottom section (28) thereby providing the player with a strategic measuring instrument on the singles stick itself that is thirty six inches in length which players can quickly and easily use to make the required measurements for placing the singles stick at the net independently of any attachments or separate measuring devices when the invention is fully assembled as illustrated in FIG. 1, irrespective of the number of, or variations in the length of, sections (18) and (26) utilized in said assembly so long as said assembly forms a singles stick that conforms to U.S.T.A. specifications for singles sticks. This expanded view of top section (18) and bottom section (28), joined together by dotted lines indicating that one or more additional sections (26) of random length may be inserted between the top section (18) and the bottom section (28) to form a single unit, as illustrated and described in FIG. 1, FIG. 2, FIG. 3 and FIG. 4, illustrates the location of said strategic measurement mark on said top section wherein said strategic measurement mark is fixed at a distance of six inches from the top of said section, and, a fixed distance of thirty six inches from the bottom of said bottom section irrespective of the random number or random lengths of lower sections (26) utilized in said assembly forming the complete unit as illustrated in FIG. 1, FIG. 2, FIG.

3 and FIG. 4 which conforms to U.S.T.A. specifications for singles sticks.

While this particular placement of said strategic measurement mark, namely, six inches from the top of top section (18) is the preferred embodiment of the strategic measurement mechanism, other locations of said strategic measurement mark and corresponding modifications will become evident to those skilled in the art.

OPERATION OF MY INVENTION

The various parts of my invention combine together as illustrated in FIG. 2, FIG. 3 and FIG. 4 to operate as an improved singles stick which supports net (44) as specified by U.S.T.A. tennis rules.

More specifically, the top portion of the top section (18) operates as a net height adjustment mechanism (9) as illustrated and described in FIG. 5, FIG. 6, FIG. 7, FIG. 8 and FIG. 9. A strategic measurement mark (40) is located on the outside of top section (18) that operates as a strategic measuring instrument as illustrated and described FIG. 18, for quick, convenient, and efficient measurement of the required distance (58) for placing said improved singles sticks at the proper net position (60), as prescribed by U.S.T.A. tennis rules. Said improved singles stick further operate to disassemble into sections (18) and (26) as illustrated in FIG. 2, FIG. 3 and FIG. 4 to provide a means whereby said improved singles sticks can be reduced in length for convenient and safe storage in most equipment tote bags used by tennis players.

Various other modifications of my invention will be apparent to those skilled in the art. Thus, the scope of my invention is to be limited only by the appended claims.

Accordingly, I claim:

1. A singles stick apparatus for holding the top edge of a regulation lawn tennis net at its regulation height above the ground for singles play, the net having a band of predetermined width along its upper edge, comprising:

an elongated stick member of predetermined length having a plurality of separable sections, means for releasably attaching said sections in an end-to-end relationship, one end of said stick having a longitudinal slot, said slot extending from said one end to a predetermined distance towards the other end of said stick, said predetermined distance of said slot serving to accommodate tennis net bands of various widths, said one end of said stick having a plurality of longitudinally spaced openings extending perpendicular to said slot, adjustment means for adjusting the position of a net band within and relative to said slot, thus adjusting the height of a net relative to a tennis court playing surface, said adjustment means being in the form of a peg for selectively extending into said openings and across said slot to contact the bottom edge of a tennis net band, a measuring means adjacent said one end of said stick, said measuring means indicating a predetermined length of said stick when said sections are assembled.

2. A singles stick apparatus as defined in claim 1 wherein, said sections are connected in an end-to-end telescoping manner.

3. A singles stick apparatus as defined in claim 1 wherein, said measuring means is a mark placed six inches from said one end and thirty six inches from the other end of said stick when said sections are assembled.

* * * * *